United States Patent [19]

Hackbarth

[11] 4,083,548

[45] Apr. 11, 1978

[54] ADJUSTABLE CLAMP

[76] Inventor: Dale J. Hackbarth, 141 Avenida Lysanne, Anaheim, Calif. 92807

[21] Appl. No.: 740,780

[22] Filed: Nov. 11, 1976

[51] Int. Cl.[2] ..... B25B 1/14

[52] U.S. Cl. ..... 269/166; 269/228

[58] Field of Search ..... 269/88, 165, 166, 203, 269/228, 171

[56] References Cited

U.S. PATENT DOCUMENTS

| | | | |
|---|---|---|---|
| 669,282 | 3/1901 | Lanpher | 269/203 |
| 2,549,256 | 4/1951 | Sparling | 269/228 |

FOREIGN PATENT DOCUMENTS

| | | | |
|---|---|---|---|
| 7,365 of | 1890 | United Kingdom | 269/171 |

*Primary Examiner*—Robert C. Watson

*Attorney, Agent, or Firm*—Lyon & Lyon

[57] ABSTRACT

Described herein is an adjustable clamp quickly and easily installed. The clamp comprises a mounting bar upon which is mounted two clamping jaws. One jaw is fixedly mounted and the other slidably mounted on the bar. The slidable jaw has a clamping pad affixed to a rod capable of reciprocating motion. From a retracted position, the rod can be advanced to bring the clamp pad in close contact with a workpiece being clamped by means of a toggle mechanism which locks the rod in its advanced position.

12 Claims, 4 Drawing Figures

ADJUSTABLE CLAMP

FIELD OF THE INVENTION

This invention relates to apparatus for clamping a workpiece. More specifically, it relates to a clamping apparatus adjustable to accommodate workpieces that vary in size.

BACKGROUND OF THE INVENTION

The typical clamp which is to be found in the home or industrial shop that is used to clamp workpieces of varying sizes is the well known "C" clamp having a pair of clamping surfaces one of which is linearly movable relative to the other. The linear movement of the moveable surface is accomplished by means of a hand operated turn screw. These clamps suffer a number of disadvantages in that they are awkward and slow in operation. Furthermore, frequently the clamp must be applied in a workspace where it is difficult for the workman to insert his hands in order to operate the turn screw with sufficient force to securely engage the workpiece.

To minimize these disadvantages, a number of clamping devices have been proposed in which the clamping force applied to provide secure clamping is lever actuated. Examples of such clamps are found, for example, in U.S. Pat. Nos. 2,905,038 and 3,836,136. In these devices, one clamping surface is slidably mounted on a toothed bar. The other clamping surface is connected to a lever in a manner that allows it to move linearly with movement of the lever.

In use, a workpiece is placed between the clamping surfaces and against the lever actuated surface. The slidable member is moved into position against the workpiece. Then the lever is moved to force its associated clamping surface against the workpiece to provide secure engagement.

These devices, while they overcome some of the disadvantages associated with the typical "C" clamp, remain somewhat awkward to operate. Clearly, therefore, it would be desirable to have available an adjustable clamp capable of being operated more efficiently than those already known to the art.

OBJECTS OF THE INVENTION

One object of the present invention is to provide an improved clamp adjustable to engage workpieces of different sizes.

Another object of this invention is to provide a clamp of simple operation capable of rapid and secure engagement with a workpiece.

Other objects and advantages to be derived from the present invention will be apparent to those skilled in the art from a consideration of the following description of the invention and the accompanying drawings.

DETAILED DESCRIPTION OF THE INVENTION

Figure 1:
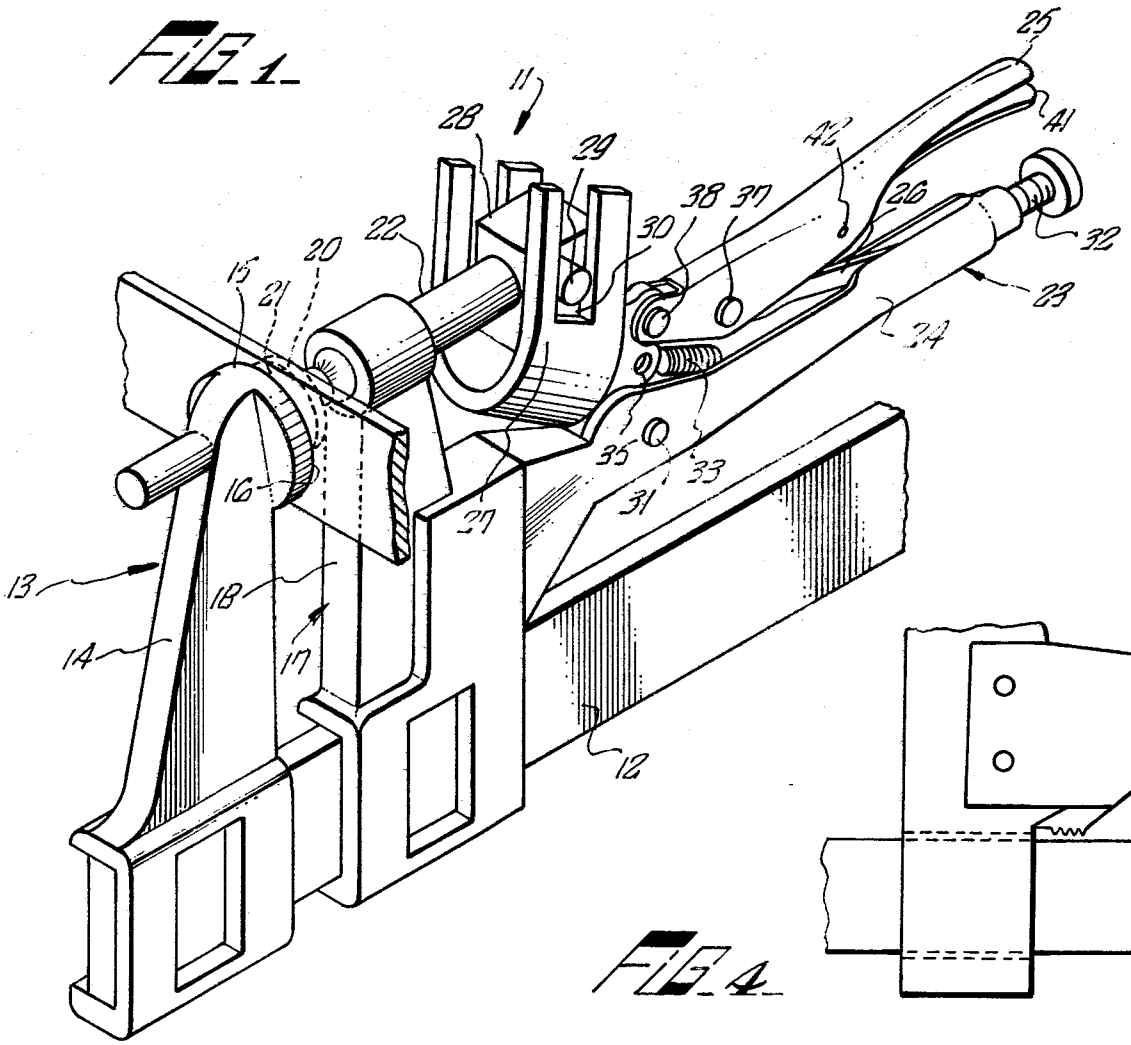
FIG. 1 is an isometric view illustrating a preferred embodiment of the present invention.
Figure 2:
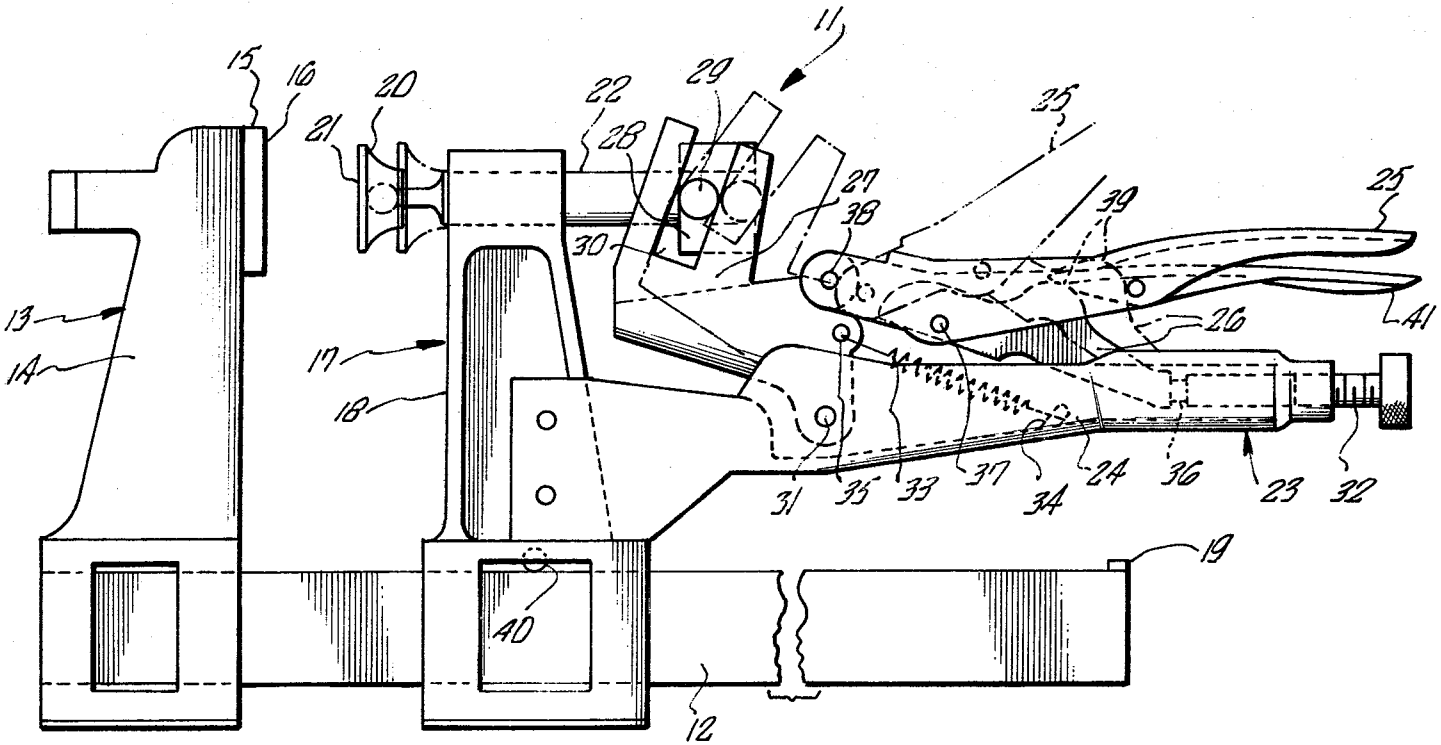
FIG. 2 is a side elevation of the article of FIG. 1 showing details of construction.

A presently preferred embodiment of the adjustable clamp of the present invention is indicated by reference numeral 11 in FIGS. 1 and 2. In FIG. 1, the invention is illustrated in perspective showing a workpiece being securely held. With reference now to FIG. 2, the detailed construction of adjustable clamp 11 will be described.

In FIG. 2, reference numeral 12 represents a mounting bar at one end of which is fixedly mounted clamping jaw 13 comprised of an arm 14 to which is secured clamp pad 15 having a clamping surface 16. As shown, mounting bar 12 is rectangular in cross-section. However, it can be circular or have any other regular cross-section. Clamping jaw 13 can be attached to the mounting bar in any convenient manner. For example, it can be riveted or bolted to the bar. Alternatively, the bar and clamping jaw can be cast or otherwise fabricated as a single member. However, as will be appreciated by those skilled in the art, it is within the scope of this invention to mount jaw 13 at some position along bar 12 other than at the end. Furthermore, the construction of bar 12 and clamping jaw 13 can be such that the latter can be mounted at a plurality of points along bar 12. For example, by providing a number of holes along the length of bar 12, clamping jaw 13 can be bolted at a discrete number of fixed points. Alternatively, the bar 12 and clamping jaw 13 can constitute a ratchet and pawl arrangement.

As shown, clamping pad 15 is attached to arm 14 in a manner that allows it no movement. However, clamping pad 15 can be attached by means of a ball and socket or other swivel joint so as to be capable of limited movement if desired. This type of mount could be advantageous when the sides of the workpiece are other than parallel and to reduce stress on the pad.

Positioned in an opposed relationship to clamping jaw 13 is a second clamping jaw 17 that comprises an arm 18 slidably mounted on bar 12. As shown in FIG. 1, arm 18 forms a channel for bar 12 in a manner that allows it to be freely moved up and down bar 12. Preferably, means are provided to prevent arm 18 from sliding off the end of bar 12. For example, a raised projection 19 at the end of bar 12 or a pin projecting from the sides can be employed for this purpose.

Affixed to arm 18 is clamping pad 20 having a clamping surface 21. Clamp pad 20 is mounted on rod 22 which is capable of reciprocal motion in a hollow cylindrical channel in arm 18. Those skilled in the art will appreciate that the rod, though shown as if circular in cross-section, can have a square or other regular cross-section. As shown, pad 20 is mounted on rod 22 by means of a ball and socket joint which allows it to swivel and thereby provide stress relief as well as accommode workpieces whose sides are other than parallel. However, the pad may be integral with the rod.

The mechanism for imparting reciprocating motion to rod 22 is toggle assembly 23 which comprises handle 24, lever arm 25, toggle link 26 and pivotable connector link 27. Rod 22 is attached to connector link 27 by means of a pin-and-slot connection. To provide this connection, rod 22 is provided, at its end opposite the clamping pad, with a block portion 28 from which extends, on either side, a pin 29. Pin 29 is received into slot 30 in connector link 27.

In actual operation, the workpiece is placed against clamp pad 15 and clamping jaw 17 is advanced along bar 12 so that clamp pad 20 also contacts the workpiece. Then lever arm 25 is closed from the open position. When the lever arm is closed, the toggle mechanism 23, as described more fully hereinafter, causes connector link 27 to pivot about pin connector 31 by which it is connected to handle 24. The pivotal motion of member 27 is translated into linear motion of rod 22 as indicated by phantom lines in FIG. 2.

The extent to which rod 22 can be advanced by manipulation of lever arm 25 is regulated by adjusting screw 32. As screw 32, which meshes with a hole in the end of handle 24, advances it contacts and moves toggle line 26 along handle 24 toward arm 18 causing link 27 to pivot on pin 31 in a counter-clockwise direction thereby advancing rod 22.

As the connector pin pivots, tension spring 33, which is attached to handle 24 by suitable means such as hook 34 and attached to connector link 27 by means of eyelet 35, is further tensioned. Therefore, when the adjusting screw is reversed, relaxation of the spring keeps toggle link 25 in contact with the screw end 36.

Lever arm 25 is joined to toggle link 26 by pivot pin connector 37 to form a flexible "knee" joint about 37. When the lever 25 is lifted, the joint flexes and in flexing causes rod 22 to retract from its position of maximum advance which is determined by the positioning of toggle link 26 by screw 32. Its retraction is limited by contact of pad 20 with arm 18. Retraction of rod 22 occurs because connector link 27 pivots simultaneously about pivot pin connector 38, which connects it to lever arm 25, and about pivot pin connector 31, by which it is attached to handle 24.

As indicated above, to advance rod 22 into firmer contact with the workpiece, lever arm 25 is closed to, in effect, straighten the "knee" of the flexible joint. Maximum advance of rod 22 occurs when the pivot points at 38 and 37 form a straight line with the end of toggle link 26. This alignment can be referred to as the "over-the-center" position. To prevent the closing of lever 25 from forcing the mechanism past this point, toggle link 26 is provided with a shoulder 39 which abuts the under side of lever arm 25 when the over-the-center position is reached to prevent further closing. In this position, lever arm 25 and toggle link 26 form a rigid bar along which the force exerted by the workpiece against clamp pad 20 is transmitted to lock the clamp in the closed position. However, when lever arm 25 is raised to lift pivot 37 above the line forming he over-the-center position, the force exerted by the workpiece will cause the clamp to "pop" or spring open.

Figure 4:
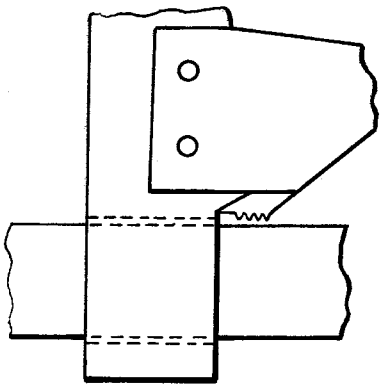
FIG. 4 is a side elevation of yet another modification of arm 18 of FIG. 2 as it engages bar 12.
Figure 3:
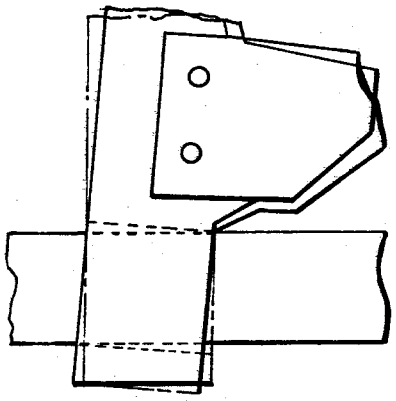
FIG. 3 is a side elevation of a modification of arm 18 of FIG. 2 shown as it engages bar 12.

When lever arm 25 is closed causing rod 22 to advance into closer contact with the workpiece, the workpiece exerts force on the clamping jaw 17 which tends to displace the jaw back along the bar. If this were to happen, secure clamping could not be attained. Therefore means must be provided to prevent this displacement. One way to accomplish this is by means of a ratchet and pawl arrangement between clamping jaw 17 and bar 12. However, it is preferred to employ ball-bearing 40 for this purpose. Thus, when rod 22 is advanced to force clamping pad 20 into close contact with a workpiece, clamping jaw 17 tilts backward slightly by pivoting on bearing 40. Disengagement from uniform contact with a flat workpiece when this tilt occurs is prevented by the swivel mount of clamp pad 20. When the jaw tilts back, force is exerted against bar 12 through bearing 40 which tends to resist displacement of jaw 17 away from the workpiece. If desired, bearing 40 can be eliminated. When this is done, arm 18 itself, properly dimensioned of course, tilts back to engage bar 12 as shown in FIG. 3. In another embodiment, shown in FIG. 4, the arm 18 may be provided with teeth 43 which will contact bar 12 when the arm tilts back.

As pointed out above, when it is desired to release the clamp the lever arm 25 need only be lifted to raise pivot 37 above the over-the-center position. Preferably, however, a quick release means is provided. One such suitable means is illustrated in FIG. 2 as quick release lever 41. Release lever 41 is disposed between lever arm 25 and toggle link 26. Its fulcrum is at pivot connector pin 42. Its forward most portion contacts shoulder 39 on toggle link 26. When raised, lever 42 forces lever 25 upward to raise pivot point 37 above the over-the-center position. When this happens, of course, the clamp springs open.

From the foregoing it can be seen that the present invention provides an adjustable clamp that is exceptionally quick and simple in operation. All that is required is that a workpiece be held between the clamping jaws. Then, with one hand, coarse adjustment of clamping jaw 17 may be had by simply sliding it against the workpiece with lever arm 25 in its open position. To complete the clamping operation, lever arm 25 is closed.

The foregoing description is one of the presently preferred embodiment of the present invention. It will be understood that this embodiment can be modified without departure from the scope or spirit of my invention which is limited only by the appended claims.

I claim:

1. An adjustable clamp comprising:

(a) a mounting bar;

(b) a first clamping jaw fixedly mounted on said mounting bar comprising an arm having a clamping pad associated therewith adapted to contact a workpiece; and (c) a second clamping jaw slidably mounted on said mounting bar comprising an arm having a first channel for slidable mounting of the jaw on said mounting bar, a clamping pad mounted on a rod for linear reciprocal motion in a second channel through said arm, said rod operatively connected to a toggle mechanism adapted to reciprocably move said rod and thereby advance or retract said clamping pad into or out of clamping contact with said workpiece said toggle assembly comprising a handle attached to the arm of said second clamping jaw, a toggle link bar having first and second ends, said first end being carried in and movable along a slot in said handle, a lever arm connected intermediate its ends to said toggle link bar at its second end to form a flexible joint, a pivotable connector link operatively connecting said rod to the toggle assembly, said connector link being pivotably connected to said lever arm at one end and pivotably connected to said handle such that raising or lowering of said lever arm causes said connector link to pivot, said connector link and said rod being joined by means adapted to translate the pivotal motion of said connector link to the linear motion of said rod such that raising of said lever arm retracts said rod and lowering of said lever arm advances said rod.

2. A clamp according to claim 1 wherein said second clamping jaw further comprises means for engaging said mounting bar to prevent displacement away from the workpiece when the toggle assembly is operated to move the clamping pad into contact with the workpiece.

3. A clamp according to claim 2 wherein the engaging means is a bearing disposed between the mounting bar and the clamping jaw in the space defined by said channel.

4. A clamp according to claim 2 wherein the engaging means are a plurality of teeth carried by said clamping jaw adapted to contact the bar.

5. A clamp according to claim 2 wherein the engaging means are an edge of the portion of said clamping jaw defining the channel.

6. A clamp according to claim 1 wherein the translating means comprise a pin on said rod received in a slot on said connector link.

7. A clamp according to claim 1 wherein means are provided for movably positioning said toggle link bar in the slot of said handle.

8. A clamp according to claim 7 wherein said positioning means is a screw mating with a hole in said handle adapted to contact said toggle link bar.

9. A clamp according to claim 1 wherein the maximum advance of said rod occurs when the toggle bar, the point of attachment of said toggle link bar to said lever arm and the point of attachment of said connector link to said lever arm form a straight line.

10. A clamp according to claim 9 wherein means are provided to prevent said lever arm from being lowered past the position at which the maximum advance of said rod occurs.

11. A clamp according to claim 10 wherein said preventing means is a shoulder on said toggle link arm adapted to contact said lever arm.

12. An adjustable clamp comprising:

(a) a mounting bar;

(b) a first clamping jaw fixedly mounted on said mounting bar comprising an arm having a clamping pad associated therewith adapted to contact a workpiece; and (c) a second clamping jaw slidably mounted on said mounting bar comprising an arm having a first channel for slidable mounting of the jaw on said mounting bar, a clamping pad mounted on a rod for linear reciprocal motion in a second channel through said arm, said rod operatively connected to a toggle mechanism adapted to reciprocably move said rod and thereby advance or retract said clamping pad into or out of clamping contact with said workpiece, said toggle assembly comprising a handle attached to the arm of said second clamping jaw, a toggle link bar having first and second ends, said first end being carried in and movable along a slot in said handle, a lever arm connected intermediate its ends to said toggle link bar at its second end to form a flexible joint, a pivotable connector link operatively connecting said rod to the toggle assembly, said connector link being pivotably connected to said lever arm at one end and pivotably connected to said handle such that raising or lowering of said lever arm causes said connector link to pivot, said connector link and said rod being joined by means adapted to translate the pivotal motion of said connector link to the linear motion of said rod such that raising of said lever arm retracts said rod and lowering of said lever arm advances said rod, and means for engaging said mounting bar to prevent displacement of the clamping jaw from the workpiece when the toggle assembly is operated to move the clamping pad into contact with the workpiece, said means comprising an edge of the portion of the clamping jaw defining the first channel, said second jaw being adapted to tilt back when clamping contact is made with the workpiece to engage said mounting bar.

* * * * *